US011054219B2

(12) United States Patent
Aw et al.

(10) Patent No.: US 11,054,219 B2
(45) Date of Patent: Jul. 6, 2021

(54) WEARABLE PROGRAMMING UNIT FOR DEPLOYING AIR BURST MUNITION

(71) Applicant: Advanced Material Engineering Pte. Ltd., Singapore (SG)

(72) Inventors: Cheng Hok Aw, Singapore (SG); Thomas Yong Lim Ang, Singapore (SG); Soo Chew Sie, Singapore (SG); Siwei Huang, Singapore (SG)

(73) Assignee: Advanced Material Engineering Pte Ltd, Singapore (SG)

( * ) Notice: Subject to any disclaimer, the term of this patent is extended or adjusted under 35 U.S.C. 154(b) by 373 days.

(21) Appl. No.: 16/322,489

(22) PCT Filed: Aug. 7, 2017

(86) PCT No.: PCT/SG2017/050394
§ 371 (c)(1),
(2) Date: Feb. 1, 2019

(87) PCT Pub. No.: WO2018/030955
PCT Pub. Date: Feb. 15, 2018

(65) Prior Publication Data

US 2021/0156648 A1 May 27, 2021

(30) Foreign Application Priority Data

Aug. 8, 2016 (SG) ..... 10201606547W

(51) Int. Cl.
*F41G 3/06* (2006.01)
*F41G 3/16* (2006.01)
*F42B 12/34* (2006.01)

(52) U.S. Cl.
CPC ..... *F41G 3/06* (2013.01); *F41G 3/165* (2013.01); *F42B 12/34* (2013.01)

(58) Field of Classification Search
CPC ... F41A 27/28; F41G 1/00; F41G 3/00; F41G 3/06; F41G 3/165; F42B 12/34
(Continued)

(56) References Cited

U.S. PATENT DOCUMENTS 7,089,845 B2 8/2006 Friedli et al.
8,505,434 B2 * 8/2013 Wieland ..... F41G 1/473 89/203
(Continued)

FOREIGN PATENT DOCUMENTS

CN 204630480 U 9/2015
EP WO2015/075036 A1 5/2015

OTHER PUBLICATIONS

International Search Report of International Patent Application No. PCT/SG2017/050394 completed Nov. 8, 2017 and dated Nov. 15, 2017 (2 pages).
(Continued)

*Primary Examiner* — Samir Abdosh
(74) *Attorney, Agent, or Firm* — Pyprus Pte Ltd; George D. Liu

(57) ABSTRACT

A wearable programming unit (WPU) (1 10, 1 10*a*-1 10*b*) for assisting a user deploy air burst munition (ABM, 10) from a rifle (20) in an intuitive manner is described. The WPU has a ballistic processor (112), wireless communication channels (120), a vibrator (130), a display (130), a mode button (150) and up/down select buttons (160, 161). After an ABM is selected and loaded into the rifle, and a deployment distance entered in the WPU, the ballistic processor calculates and outputs a time of burst T and barrel angle alpha. The barrel angle alpha is received by a sighting unit (104) and appears as a target marker. Once the rifle is tilted and/or
(Continued)

moved so that a centre of the sighting unit coincides with the target marker, the WPU vibrates as a signal to the user to trigger the rifle.

11 Claims, 2 Drawing Sheets

(58) Field of Classification Search
USPC ..... 235/404
See application file for complete search history.

(56) References Cited

U.S. PATENT DOCUMENTS

| | | | | |
|---|---|---|---|---|
| 2011/0010981 | A1* | 1/2011 | Wieland | F41G 3/06 42/114 |
| 2015/0153137 | A1 | 6/2015 | Newzella et al. | |
| 2016/0091282 | A1 | 3/2016 | Baker et al. | |
| 2018/0231354 | A1* | 8/2018 | Sullivan | F41G 3/12 |
| 2020/0141697 | A1* | 5/2020 | Sullivan | F41G 3/22 |

OTHER PUBLICATIONS

Written Opinion of International Patent Application No. PCT/SG2017/050394 completed Nov. 8, 2017 and dated Nov. 15, 2017 (4 pages).

* cited by examiner

WEARABLE PROGRAMMING UNIT FOR DEPLOYING AIR BURST MUNITION

FIELD OF INVENTION

The present invention relates to low velocity projectiles such as air burst munitions and associated wearable programming unit. The wearable programming unit allows more rapid or intuitive deployment of these air burst munitions.

BACKGROUND

With advances in mobile computing, law enforcement and military personnel now carry advanced electronic aids. For example, US published document 2016/0091282 by Baker, et. al. describes a mobile ballistics processing and targeting display system. This system stores ballistic data of a plurality of bullets, receives input from other connected electronic devices (such as a laser rangefinder, compass and GPS), receives atmospheric data (such as wind speed, wind direction, temperature, pressure and relative humidity), and displays real-time map of the surroundings; the system thus allows a user to identify one's location on the map; results of computation is displayed as a graphical representation of in-flight bullet characteristics. It appears that this mobile ballistic system adds a lot of weight and bulk to a rifle carried by the law enforcement or military personnel.

In another approach, U.S. Pat. No. 7,089,845, assigned to Chartered Ammunition Industries, describes an airburst infantry weapon employing a fire control device F, which includes an image visualization unit V, an angle measuring unit Y, a laser distance measuring unit L and a data processor EDV. A three-stage aiming process is described, namely, a rough aiming where a deployment distance is approximated; an actual aiming where the data processor determines a target marker position on the image visualization unit; and a fine aiming where the rifle is moved so that the target marker coincides with the target image.

In reality, the method described in U.S. Pat. No. 7,089,845 does not allow sufficient rapid aiming and firing, whilst the rifle in US 2016/0091282 may be too heavy to move during fine aiming. It can thus be seen that there exists a need for a new system to improve intuitive deployment and accuracy of air burst munitions.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide a new system for rapid and intuitive deployment of air burst munitions. Targeting accuracy is also sought.

In one embodiment, the present invention provides a wearable programming unit associated with deploying of air burst munitions (ABM) comprising: a memory unit for storing characteristics of a plurality of ABMs from a rifle; a ballistic processor associated with the plurality of ABMs and the rifle; a display unit for displaying identity of a selected ABM; two-channel wireless communication with the selected ABM and a sighting unit disposed on the rifle; and a vibrator; wherein, when an ABM is identified and a deployment distance D is entered, the ballistic processor computes and outputs both a time of burst T and a barrel angle alpha, with the barrel angle output is visible as a target marker in the sighting unit, so that when a user tilts and/or moves the rifle to bring a centre of the sighting unit to coincide with the target marker, the wearable programming unit responds by activating the vibrator as a signal to the user to trigger the rifle so that the ABM is propelled to the target with intended effects.

In another embodiment, the present invention provides a method for enabling intuitive aiming of a rifle and deploying an air burst munition (ABM) from the rifle, the method comprising: wearing a programming unit on a user, with the programming unit within wireless communication range with both an associated rifle and a selected ABM; loading the selected ABM into the rifle; a ballistic processor located in the programming unit detecting and identifying the loaded ABM, and the ballistic processor responding by outputting a time of burst and a required barrel angle; a sighting unit receiving the required barrel angle and displays this requirement as a visual target marker; and when the user tilts and/or moves the rifle to bring a centre of sighting unit to coincide with the target marker, an angle measuring unit located at the sighting unit outputs a signal to the ballistic processor and the programming unit is activated to vibrate as a signal for the user to trigger the rifle, so that the ABM is propelled to the target with intended results.

BRIEF DESCRIPTION OF THE DRAWINGS

This invention will be described by way of non-limiting embodiments of the present invention, with reference to the accompanying drawings, in which.

DETAILED DESCRIPTION

Figure 1A:
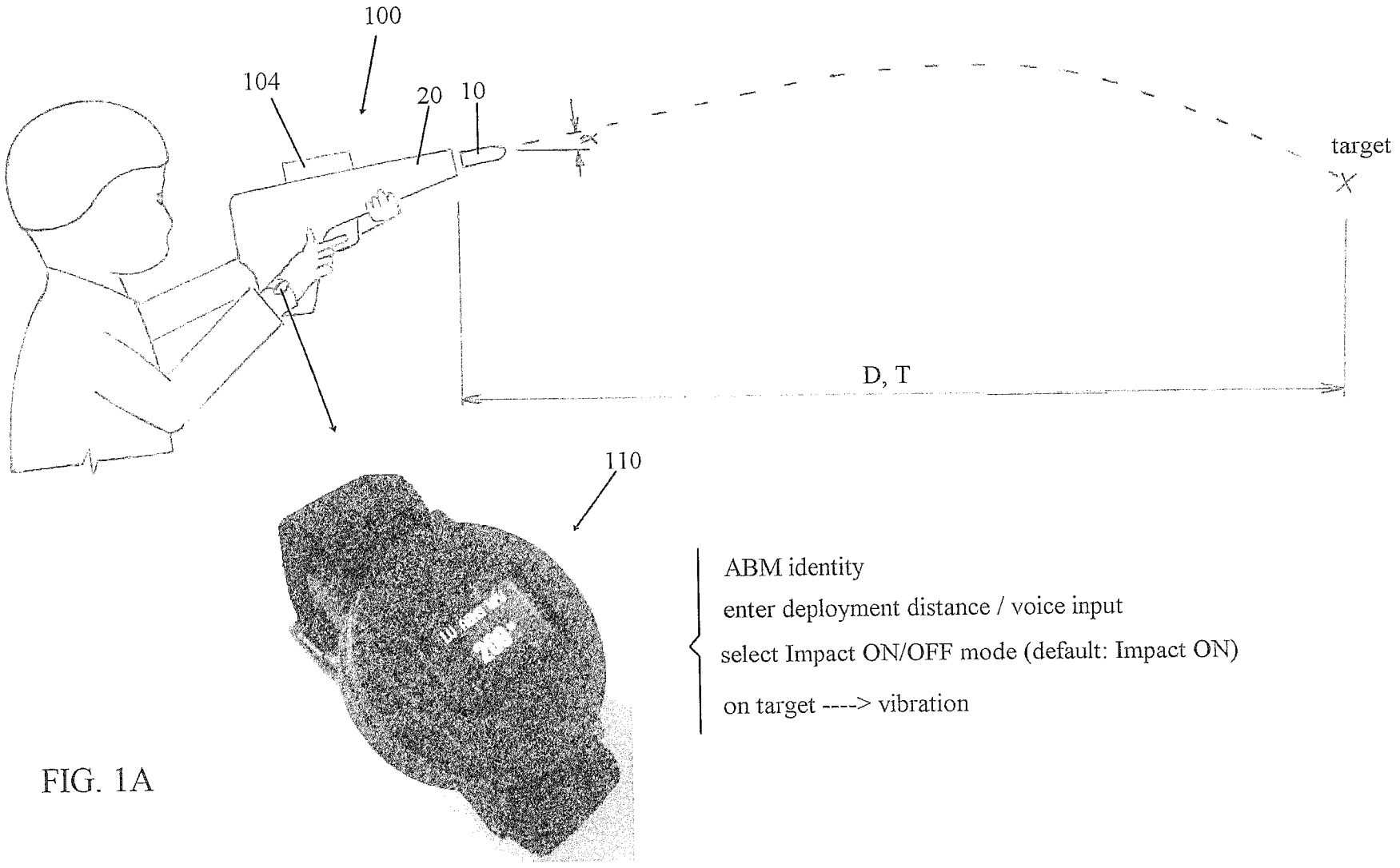
FIG. 1A illustrates a wearable programming system for deploying air burst munitions according to an embodiment of the present invention.
Figure 1B:
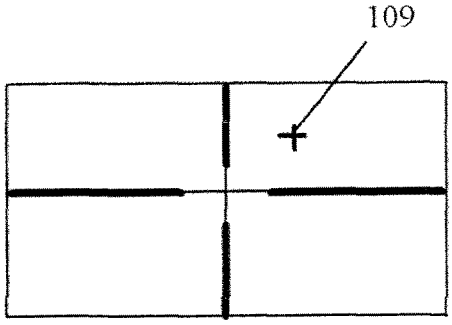
FIG. 1B illustrates a target market seen through a sight of a weapon.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

FIG. 1A shows a wearable programming system 100 for deploying air burst munitions (ABMs) 10 from a rifle 20. The programming system 100 includes a wearable programming unit 110 in wireless communication with a sighting unit 104 disposed on the rifle 20. The sighting unit 104 includes a view port 106, an angle measuring unit 107 and a wireless communication unit 108. In FIG. 1A, the wearable programming unit 110 is worn on a wrist according to one embodiment. The wearable programming unit 110 includes a ballistic processor 112, a memory unit 114, a wireless communication unit 120, a vibrator 130, a display unit 140, a mode button 150 and input/select up/down buttons 160, 161.

The memory unit 114 contains characteristics of a plurality of ABMs 10 including their ballistic data. The type of ABM 10 to be deployed from the rifle 20 is selected through the input/select up/down buttons 160,161, for example, by scrolling up or down a list and pressing a select button. The user then assesses a deployment distance D for the selected ABM; the deployment distance D can be estimated visually or with an aid of a laser rangefinder (not shown in the figure). The deployment distance D is entered into the wearable programming unit 110, for example, by also scrolling up or down a predefined list and pressing the select button. In response, the ballistic processor 112 computes a time of burst T and a barrel angle alpha of the rifle 20. The required barrel angle alpha is then transmitted by the wireless communication unit 120 to the sighting wireless communication unit 108 and this result is visually seen by the user as a target marker 109 in the sighting view port 106. The user responses by tilting and/or moving the rifle 20 so that a cross-hairline in a centre of the view port 106 coincides with the target marker 109. Once the cross-hairline coincides with the target marker 109, the angle measuring unit 107 feedbacks aiming of the rifle 20 to the wearable programming unit 110. The wearable programming unit 110 responds by activating the vibrator 130 to signal or prompts the user to trigger the rifle 20 for an ABM 10 to be propelled out from the barrel. As the ABM 10 exits out of the barrel, the wearable programming unit 110 transmits data containing the time of burst T to the ABM so as to achieve desired results intended by the user. With the present invention, the user uses both vibration and visual senses to aim and to fire the ABMs to the desired target. This invention is helpful during a critical moment when the user may cast an eye on the target and thus has to rely on the vibration sensing to trigger the rifle 20. This invention therefore provides more intuition for the user in deploying ABMs; as a result, the time taken to aim and to trigger the rifle is shorter than that when using a conventional rifle; at the same time, the user can visually monitor movement of the target continually and yet maintaining aim on the target, thereby allowing accuracy of deploying ABMs exceeding that when a conventional rifle is used.

In the above setting of the ABM, the mode button 150 allows the user to toggle ON/OFF impact mode of each ABM. By default, the impact mode is turned ON; this impact mode is very effective when the ABM is equipped with Applicant's electro-mechanical impact sensing disclosed in U.S. Pat. No. 9,163,916. Even when impact mode is turned ON, the ABM is still effective in a burst mode (while the ABM is still airborne). In another embodiment, the mode button 150 may be configured to toggle between impact and input modes, with the up/down buttons for selection and changing the mode button 150 to automatically enter a selection; in other words, this will dispense away with many dedicated input buttons.

In the above wireless communication between the wearable programming unit 110 and the sighting unit 104 or between the wearable programming unit 110 and the ABM 10, two-channel communication is facilitated; in other words, there is handshaking or feedback from the receptor to the transmitter; this is to ensure security and integrity of wireless transmission. In another embodiment, such wireless communication is via paired Bluetooth communication and the hopping frequency and proximity both provide added security. Alternatively, other mid-range wireless communication operable at 13.56 MHz is also possible.

Figure 2A:
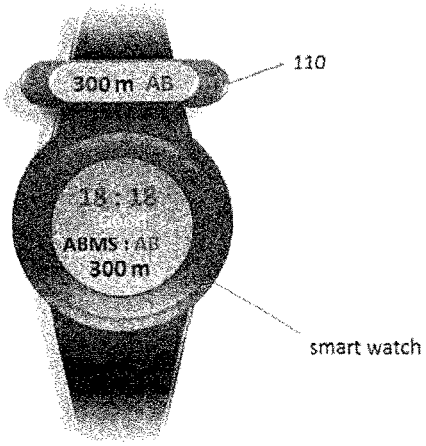
FIG. 2A illustrates a wearable programming unit according to another embodiment of the present invention.

The above wearable programming unit 110 has been described as worn on a wrist of the user. In another embodiment, it is possible that a wearable programming unit 110*a* is configured as an attachable unit to a strap of a smart watch, for example as shown in FIG. 2A. This wearable programming unit 110*a* may then have an additional wireless communication channel with the smart watch, for example, by making use of the display and mode/input/select buttons that are already on the smart watch.

Figure 2B:
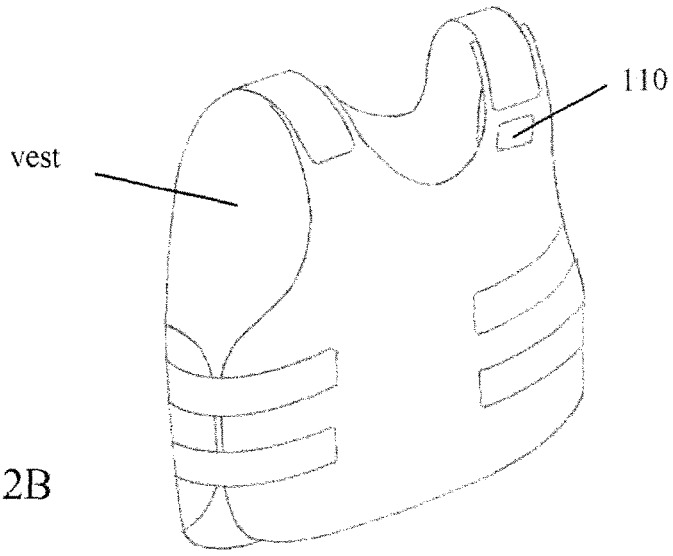
FIG. 2B illustrates a wearable programming unit according to yet another embodiment.

In another embodiment, a wearable programming unit 110*b* is configured as an attachable unit onto a safety vest of a user. This wearable programming unit 110*b* may be worn on a shoulder portion of the safety vest, as shown in FIG. 2B. Preferably, this wearable programming unit 110*b* may include a voice input function, for example, to enter a deployment distance D of an ABM 10.

While specific embodiments have been described and illustrated, it is understood that many changes, modifications, variations and combinations thereof could be made to the present invention without departing from the scope of the invention.

The invention claimed is:

1. A wearable programming unit associated with deploying of air burst munitions (ABM) comprising:

a memory unit for storing characteristics of a plurality of ABMs from a rifle;

a ballistic processor associated with the plurality of ABMs and the rifle;

a display unit for displaying identity of a selected ABM;

two-channel wireless communication with the selected ABM and a sighting unit disposed on the rifle; and a vibrator;

wherein, when an ABM is identified and a deployment distance D is entered, the ballistic processor computes and outputs both a time of burst T and a barrel angle alpha, with the barrel angle output is visible as a target marker in the sighting unit, so that when a user tilts and/or moves the rifle to bring a centre of the sighting unit to coincide with the target marker, the wearable programming unit responds by activating the vibrator as a signal to the user to trigger the rifle so that the ABM is propelled to the target with intended effects.

2. The wearable programming unit according to claim 1, further comprising an impact mode toggle button to selectively turn OFF a default impact mode.

3. The wearable programming unit according to claim 1, wherein the wireless communication conforms to a Bluetooth protocol.

4. The wearable programming unit according to claim 1, wherein the wireless communication is transmitted at 13.56 MHz.

5. The wearable programming unit according to claim 1 is wearable on a wrist of the user.

6. The wearable programming unit according to claim 5, wherein the programming unit is an attachment onto a strap of a smart wrist watch.

7. The wearable programming unit according to claim 6, further comprising a wireless communication channel between the programming unit and the smart wrist watch, and the mode and up/down buttons are those located on the smart wrist watch.

8. The wearable programming unit according to claim 1 is wearable on a security vest of the user.

9. The wearable programming unit according to claim 1, further comprising a voice input for entering the deployment distance D of the selected ABM.

10. The wearable programming unit according to claim 1, wherein the sighting unit further comprising an angle measuring unit, which responds by handshaking or sending a feedback signal to the wearable programming unit when the barrel is at the required angle alpha for firing.

11. A method for enabling intuitive aiming of a rifle and deploying an air burst munition (ABM) from the rifle, the method comprising:

wearing a programming unit on a user, with the programming unit within wireless communication range with both an associated rifle and a selected ABM;

loading the selected ABM into the rifle;

a ballistic processor located in the programming unit detecting and identifying the loaded ABM, and the ballistic processor responding by outputting a time of burst and a required barrel angle;

a sighting unit receiving the required barrel angle and displays this requirement as a visual target marker; and when the user tilts and/or moves the rifle to bring a centre of sighting unit to coincide with the target marker, an angle measuring unit located at the sighting unit outputs a signal to the ballistic processor and the programming unit is activated to vibrate as a signal for the user to trigger the rifle, so that the ABM is propelled to the target with intended results.

* * * * *